US008371393B2

(12) United States Patent
Higuchi et al.

(10) Patent No.: US 8,371,393 B2
(45) Date of Patent: Feb. 12, 2013

(54) ELECTRIC STAPLER AND OPERATION METHOD OF ELECTRIC STAPLER

(75) Inventors: Kazuo Higuchi, Tokyo (JP); Masashi Shimamura, Tokyo (JP)

(73) Assignee: Max Co., Ltd., Tokyo (JP)

( * ) Notice: Subject to any disclaimer, the term of this patent is extended or adjusted under 35 U.S.C. 154(b) by 265 days.

(21) Appl. No.: 12/780,435

(22) Filed: May 14, 2010

(65) Prior Publication Data

US 2010/0288814 A1 Nov. 18, 2010

(30) Foreign Application Priority Data

May 15, 2009 (JP) ..... P. 2009-118280

(51) Int. Cl.
*B25C 7/00* (2006.01)
*B25B 21/02* (2006.01)

(52) U.S. Cl. ..... 173/1; 227/155

(58) Field of Classification Search ..... 173/1–11, 173/176–183, 157–162.1; 227/1–7, 175.1–182.1, 227/120, 155; 242/608.2–608.3; *B25B 21/02; B25C 7/00*

See application file for complete search history.

(56) References Cited

U.S. PATENT DOCUMENTS

| | | | | |
|---|---|---|---|---|
| 4,623,082 | A * | 11/1986 | Kurosawa | 227/7 |
| 5,975,396 | A * | 11/1999 | Manabe | 227/2 |
| 7,222,771 | B2 * | 5/2007 | Yoshie | 227/155 |
| 7,234,622 | B2 * | 6/2007 | Masuda et al. | 227/135 |
| 7,311,236 | B2 * | 12/2007 | Smith et al. | 227/131 |
| 7,311,237 | B2 * | 12/2007 | Yoshie | 227/155 |
| 7,314,156 | B2 * | 1/2008 | Yoshie et al. | 227/148 |
| 7,665,645 | B2 * | 2/2010 | Smith et al. | 227/155 |
| 7,926,799 | B2 * | 4/2011 | Iguchi | 270/45 |
| 8,016,855 | B2 * | 9/2011 | Whitman et al. | 606/205 |
| 8,146,908 | B2 * | 4/2012 | Terao | 270/58.09 |
| 2006/0016850 | A1 * | 1/2006 | Yoshie | 227/155 |
| 2006/0273134 | A1 * | 12/2006 | Smith et al. | 227/131 |
| 2008/0054042 | A1 * | 3/2008 | Smith et al. | 227/5 |
| 2011/0017797 | A1 * | 1/2011 | Yagi et al. | 227/85 |

FOREIGN PATENT DOCUMENTS

| | | |
|---|---|---|
| JP | 8-187681 | 7/1996 |
| JP | 2001-191265 | 7/2001 |
| JP | 2006-116638 | 5/2006 |

* cited by examiner

*Primary Examiner* — Robert Long

(74) *Attorney, Agent, or Firm* — Drinker Biddle & Reath LLP

(57) ABSTRACT

An electric stapler is operated by a paper bundle pinching step of relatively moving a table part and a driver unit and also pinching a paper bundle; a staple separation step of folding a staple into U-shape by a forming plate and also separating the folded U-shape staple from a staple sheet by moving a driver; a penetration step of penetrating legs of the staple into the paper bundle by further moving the driver; a clinch step of inward folding the legs by a clinch device; and a paper bundle releasing step. A relative movement of the table part and the driver unit, the forming plate, the driver, and the clinch device are powered by a single motor. A driving speed of the motor in the steps excluding the penetration step and the clinch step is slower than the driving speed of the motor in the penetration step and the clinch step.

5 Claims, 7 Drawing Sheets

TWO SHEETS; 24V; NO PWM CONTROL;
A CHARACTERISTIC = 63.6(dB);
ONE CYCLE = 270(msec)

TWO SHEETS; 24V; PWM CONTROL;
A CHARACTERISTIC = 61.2(dB);
ONE CYCLE = 300(msec)

ELECTRIC STAPLER AND OPERATION METHOD OF ELECTRIC STAPLER

BACKGROUND OF THE INVENTION

1. Field of the Invention

The present invention relates to an electric stapler and an operation method of the electric stapler, and more particularly to an electric stapler for performing binding processing by implementing a paper bundle pinching step, a staple separation step, a penetration step, a clinch step and a paper bundle releasing step, and a motor driving method in the electric stapler.

2. Background Art

An electric stapler for penetrating a staple into a bundle of a plurality sheets of paper (hereinafter called a "paper bundle") and binding the paper bundle by electric power is known conventionally (for example, see Patent Reference 1, Patent Reference 2 and Patent Reference 3).

[Patent Reference 1] JP-A-2001-191265

[Patent Reference 2] JP-A-8-187681

[Patent Reference 3] JP-A-2006-116638

FIG. 7 is a perspective view showing one example of the electric stapler. A driver unit 3 for forming and driving a staple is mounted inside of a front end of a frame 2 of the electric stapler 1. A clincher arm 4 upward and downward movably attached to the frame 2 is disposed in the frame 2. A table part 10 including a clinch device 5 of a flat clinch type is disposed in a top of the clincher arm 4.

A staple cartridge 6 is loaded into the frame 2 from upper side. Staple sheets in the staple cartridge 6 are fed one by one by a feeding mechanism (not shown) to a position of a forming plate and a driver 7 which are located in a forward side. A staple at a leading end in the staple sheet is folded into U-shape by the forming plate and is further fed to a position located just above the driver 7. When sheets of paper is inserted between the driver unit 3 and the table part 10, the clincher arm 4 moves downward and the sheets of paper are pinched by the driver unit 3 and the table part 10. Then, the driver 7 upward moves and the staple at the leading end is separated from the staple sheet. The driver 7 moves further upward and legs of the staple are driven in the sheets of paper. Then, the clinch device 5 is actuated and both of the legs of the staple penetrating the paper bundle are inward folded by the clinch device 5 and binding processing of the paper bundle is completed.

The general electric stapler 1 is provided with a plurality of swinging arms (the clincher arm 4 is also one of the swinging arms) for converting rotational motion of a main driving gear into upward and downward reciprocating motion with respect to the main driving gear rotated by driving a motor. During one rotation of the main driving gear driven by the motor, upward and downward movement of the table part 10 by actuating the swinging arms, forming processing, driving of the staple by the driver unit 3, clinch processing by the clinch device 5, etc. are executed.

Concretely, a paper bundle pinching step of pinching the paper bundle by downward moving the table part 10, a staple separation step of folding the staple at the leading end in the staple sheet in the U-shape by the forming plate and also separating the folded staple from the staple sheet by upward moving the driver 7, a penetration step of penetrating the staple into the paper bundle by the upward moving driver 7, a clinch step of inward folding the legs of both sides of the staple penetrating the paper bundle by the clinch device 5, and a paper bundle releasing step of releasing the pinched paper bundle by upward moving the table part 10 are executed during the one rotation of the main driving gear rotated by the motor, and binding of the paper bundle is completed by this operation of one cycle.

Further, demand for a reduction of noise occurring at the time of the binding processing is now increasing, in the electric stapler in which the binding processing as described above is performed. As a method for reducing the noise of the electric stapler, a driving speed of a motor may be uniformly reduced. However, for example, if the electric stapler designed to be driven by a voltage of 24 V is driven by a voltage of 12 V so that the driving speed of the motor is uniformly decreased, a reduction in penetration performance at the time of penetrating the staple into the paper bundle, a reduction in clinch force necessary for processing for clinching the legs of the staple, etc. occur so that there was a problem that binding performance (the bindable number of sheets, etc.) in the electric stapler may be reduced.

On the other hand, a method for adopting a high-performance motor including high torque characteristics even for low-speed rotation is also contemplated in order to decrease the driving speed of the motor while preventing the reduction in the penetration performance of the staple or the reduction in the clinch force in the clinch processing. However, when the high-performance motor is used, a price of the electric stapler rises and also the number of products increases as a kind of motor increases and there was a problem that management cost or component cost may increase. Also, a method for disposing a gear box or a belt variable speed mechanism is contemplated, but there was fear that the price rises and the number of products increases similarly.

Further, a method for preventing the noise from being propagated to an outside by accommodating the whole electric stapler in a soundproof box etc. is contemplated, but there was a problem of causing upsizing of an external form of a product.

SUMMARY OF THE INVENTION

One or more embodiments of the invention provide an electric stapler and an operation method of the electric stapler which are capable of reducing operation noise during binding processing without causing upsizing of an external form of a product or an increase of a number of parts.

In accordance with one or more embodiments of the invention, an operation method of an electric stapler is provided with the steps of: a paper bundle pinching step of relatively moving a table part 10 and a driver unit 3 and also pinching a paper bundle 19 by the table part 10 and the driver unit 3; a staple separation step of folding a staple located at a forming position of staples in a staple sheet 20 into U-shape by a forming plate 8 provided in the driver unit 3 and also separating the folded U-shape staple 22 from the staple sheet 20 by moving a driver 7 provided in the driver unit 3; a penetration step of penetrating legs 24 of the staple 22 into the paper bundle 19 by further moving the driver 7; a clinch step of inward folding the legs 24 penetrating through the paper bundle 19 by a clinch device 5; and a paper bundle releasing step of releasing the paper bundle 19 by relatively moving the table part 10 and the driver unit 3 in a direction of moving away from each other. In the method, a relative movement of the table part 10 and the driver unit 3, the forming plate 8, the driver 7, and the clinch device are powered by a single motor 13. A driving speed of the motor 13 in the steps excluding the penetration step and the clinch step is slower than the driving speed of the motor 13 in the penetration step and the clinch step.

Moreover, in accordance with one or more embodiments of the invention, an electric stapler is provided with: a motor 13; a table part 10; a driver unit 3; a forming plate 8 provided in the driver unit 3; a driver 7 provided in the driver unit 3; a clinch device 5; and a motor control unit 17, 18. The electric stapler is configured to be operated by: a paper bundle pinching step of relatively moving the table part 10 and the driver unit 3 and also pinching a paper bundle 19 by the table part 10 and the driver unit 3; a staple separation step of folding a staple located at a forming position of staples in a staple sheet 20 into U-shape by the forming plate 8 and also separating the folded U-shape staple 22 from the staple sheet 20 by moving the driver 7; a penetration step of penetrating legs 24 of the staple 22 into the paper bundle 19 by further moving the driver 7; a clinch step of inward folding the legs 24 penetrating through the paper bundle 19 by a clinch device 5; and a paper bundle releasing step of releasing the paper bundle 19 by relatively moving the table part 10 and the driver unit 3 in a direction of moving away from each other. A relative movement of the table part 10 and the driver unit 3, the forming plate 8, the driver 7, and the clinch device are powered by the motor 13. The motor control unit 17, 18 is configured to control the motor 13 so that a driving speed of the motor 13 in the steps excluding the penetration step and the clinch step is slower than the driving speed of the motor 13 in the penetration step and the clinch step.

In the electric stapler and the operation method of the electric stapler according to the embodiments, the motor control unit reduces the driving speed of the motor in the steps excluding the penetration step and the clinch step, so that driving noise of the motor in binding processing, operating noise of various operating members constructing the electric stapler, impulsive noise occurring in the case where various operating members abut mutually impulsively, etc. can be reduced.

On the other hand, in the penetration step and the clinch step, necessary output torque is maintained by not reducing the driving speed of the motor, so that sufficient driving force of the motor can be ensured in the penetration step in which a high penetration load is required in order to penetrate the legs of the staple into the paper bundle and also, the sufficient driving force of the motor can be ensured in the clinch step in which a high folding load is required in order to fold the legs of the staple. As a result of this, even when the driving speed of the motor is reduced and the driving noise etc. are reduced, the necessary driving force of the motor can be ensured in the penetration step and the clinch step, so that a reduction in binding performance of the electric stapler can be prevented.

Moreover, in the electric stapler and the operation method of the electric stapler according to the embodiments, the driving speed of the motor can be controlled by the motor control unit, so that driving speed control of the motor can be performed at various timings and driving speeds without changing components for example, an upward and downward movement mechanism of the table part, a structure of the driver unit or a structure of the clinch device for implementing the paper bundle pinching step, the staple separation step, the penetration step, the clinch step and the paper bundle releasing step. As a result of this, there is no need to use a special component such as a high-performance motor, a gear box or a belt conversion mechanism and also, an increase in management cost or component cost or an increase in a kind of product associated with an increase in the number of components can be reduced.

The electric stapler of the above embodiments may further include a main driving gear 14 driven by the motor 13; and a rotational state detection device 15 configured to detect a rotational state of the main driving gear 14. In this structure, the motor control unit 17, 18 may be configured to control the motor 13 by determining a processing timing of the steps including the penetration step and the clinch step based on the rotational state of the main driving gear 14 detected by the rotational state detection device 15.

In the above structure in which a main driving gear driven by the motor and a rotational state detection device for detecting a rotational state of the main driving gear may be disposed, the motor control unit may determine processing timing of processing steps including the penetration step and the clinch step based on the rotational state of the main driving gear detected by the rotational state detection device and may reduce the driving speed of the motor.

According to the above structure in which the motor control unit may determine the processing timing of the processing steps including the penetration step and the clinch step by detecting the rotational state of the main driving gear by the rotational state detection device, since each of the processing steps of the binding processing may be executed based on the rotational state of the main driving gear rotated with the rotary driving of the motor, so that the processing timing of various processing steps can easily be determined by obtaining the rotational state of the main driving gear.

Other aspects and advantages of the invention will be apparent from the following description, the drawings and the claims.

BRIEF DESCRIPTION OF THE DRAWINGS

FIG. 3(*b*) is a diagram showing conditions to form a straight staple into U-shape staple by a forming plate and to separate the U-shape staple from a staple sheet. FIG. 3(*c*) is a diagram showing a structure of the U-shape staple.

DETAILED DESCRIPTION OF THE EXEMPLARY EMBODIMENT

An electric stapler according to an exemplary embodiment of the invention will hereinafter be described with reference to the drawings. In addition, the electric stapler according to the exemplary embodiment includes a configuration similar to that of the general electric stapler 1 described already. Therefore, the same numerals are assigned to the portions made of the same configuration as the configuration described already and also its detailed description is omitted in the exemplary embodiment.

Figure 1:
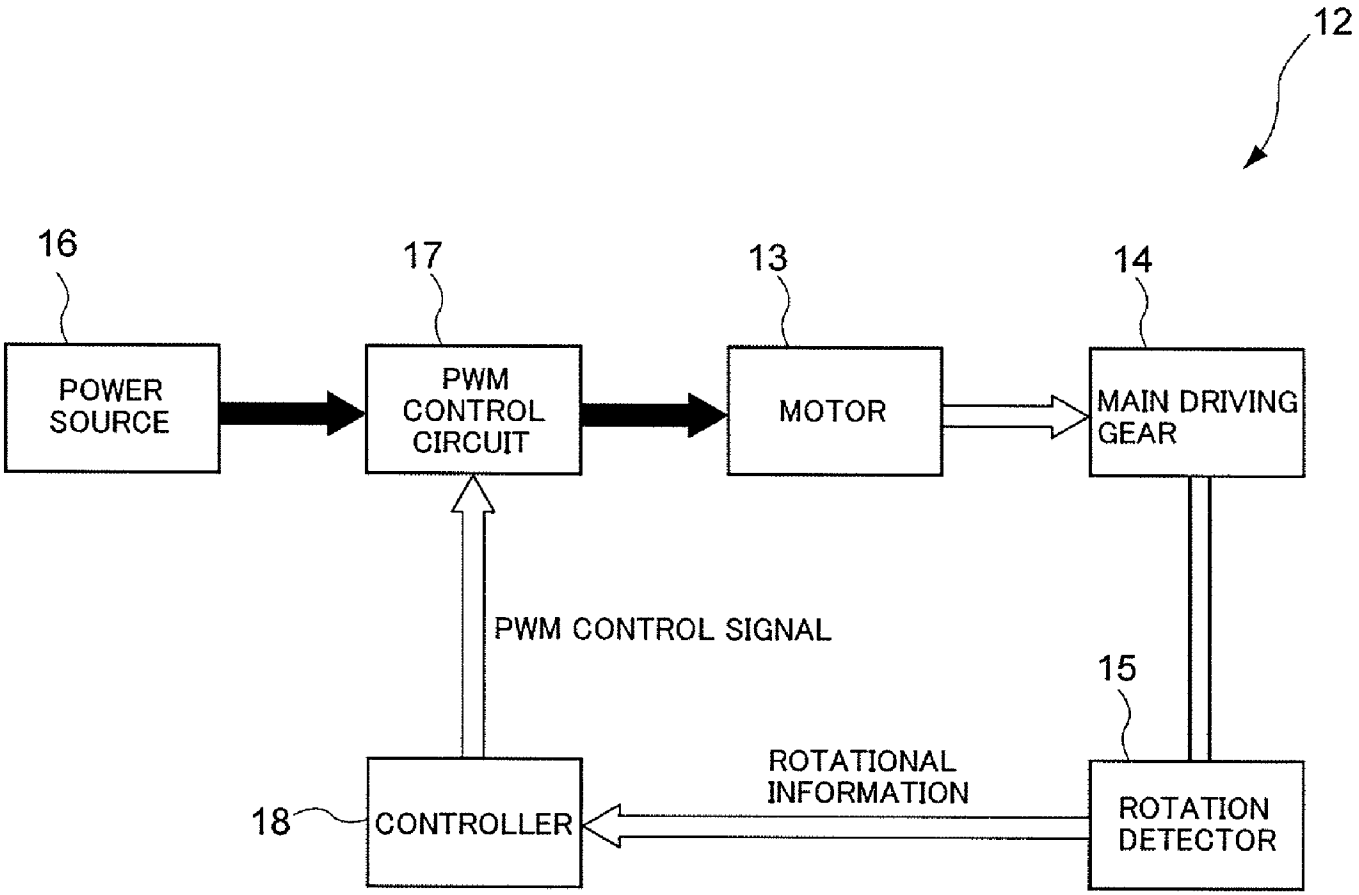
FIG. 1 is a block diagram showing a schematic configuration of a functional part for performing driving control of a motor in an electric stapler according to an exemplary embodiment.

FIG. 1 is a block diagram showing a schematic configuration of a functional part for performing driving control of a motor in the electric stapler according to the exemplary embodiment.

An electric stapler 12 has a motor 13, a main driving gear 14 rotated and driven by the motor 13, a rotation detector (a rotational state detection device) 15 for detecting a rotational state of the main driving gear 14, a PWM (Pulse Width Modulation) control circuit (motor control unit) 17 for controlling a voltage supplied from a power source 16 to the motor 13, and a controller (motor control unit) 18 for outputting a PWM control signal to the PWM control circuit 17.

The motor 13 is constructed of a general brush motor, and the main driving gear 14 is rotated and driven according to driving of this motor 13.

A plurality of swinging arms for actuating a clinch device 5, a driver 7, a forming plate 8, and upward and downward movement of a table part 10 based on a rotation of the main driving gear 14 are connected to the main driving gear 14 directly or indirectly through other gears. By rotating the main driving gear 14 in one rotation, the clinch device 5, a driver unit (including the forming plate 8 and the driver 7) and the table part 10 are driven, so that a paper bundle is bound.

The rotation detector 15 is constructed of a photo-interrupter. The main driving gear 14 is provided with slits, and a light emitter (light emitting diode) and a light receiver (photodiode) oppositely installed so as to sandwich the slits are arranged. In the photo-interrupter, light outputted from the light emitter is detected by the light receiver and information about a number of counts of the detected light is outputted to the controller 18 as rotational information.

The PWM control circuit 17 performs on/off control of a voltage by pulse control while maintaining a voltage value of the power source supplied from the power source 16 to the motor 13 at a constant value so that time (width) for which the voltage is outputted is adjusted, and thereby a driving control of the motor 13 is performed.

The PWM control circuit 17 is constructed of a general FET (field effect transistor), and performs the on/off control of the voltage based on the PWM control signal received from the controller 18. By voltage control of the PWM control circuit 17, electric energy supplied to the motor 13 is adjusted according to a duty ratio.

The controller 18 has a function of outputting the PWM control signal for controlling a pulse control state in the PWM control circuit 17 with the rotational information received from the rotation detector 15 to the PWM control circuit 17. Concretely, the controller 18 detects a rotational angle of the main driving gear 14 based on the rotational information and changes the duty ratio in the PWM control circuit 17 based on the detected rotational angle.

Figure 2:
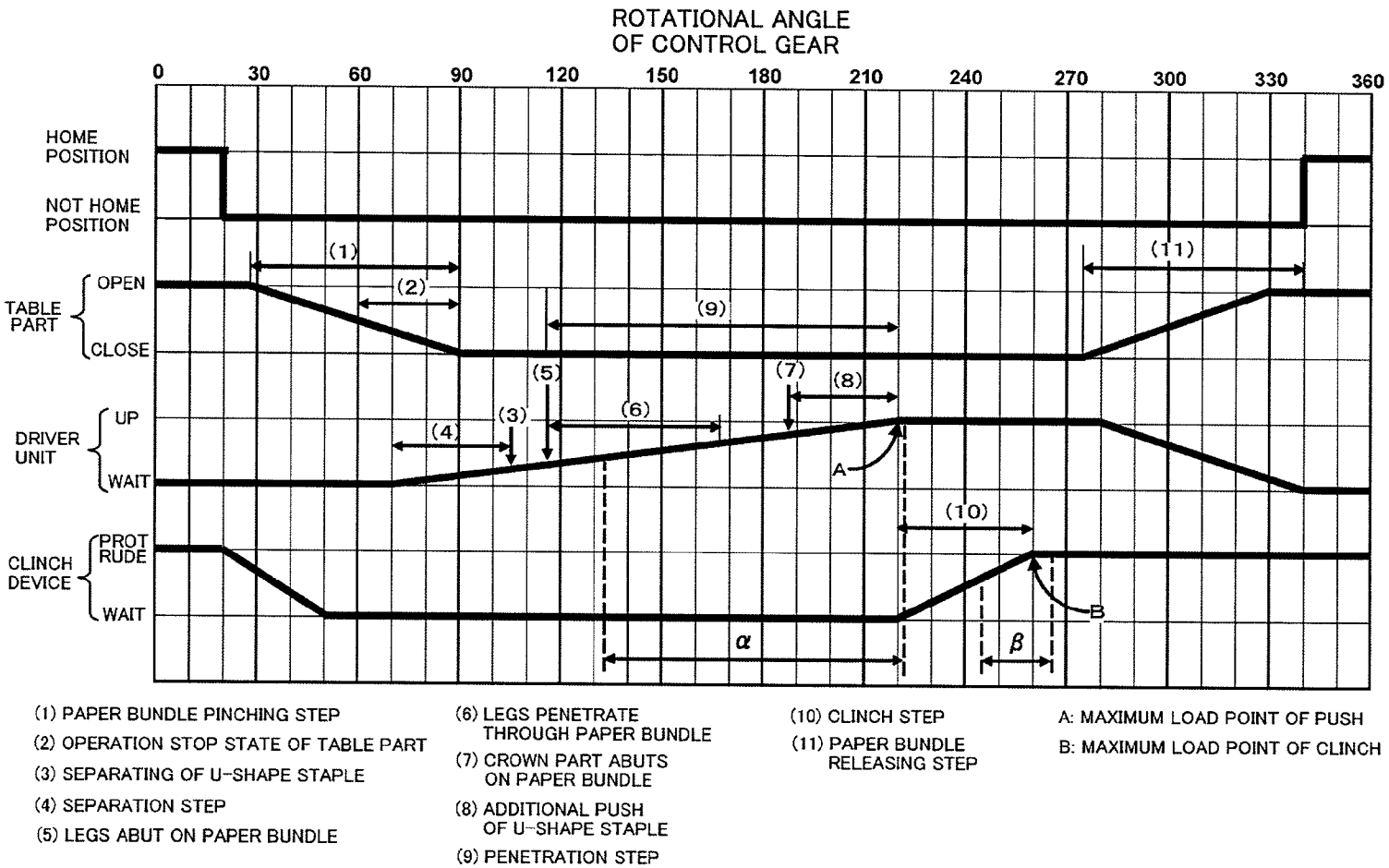
FIG. 2 is a diagram showing a driving situation of a clinch device, a driver unit and a table part driven according to a rotational angle of a main driving gear.

FIG. 2 shows a driving situation of the clinch device 5, the driver unit 3 and the table part 10 driven according to the rotational angle of the main driving gear 14.

When the rotational angle of the main driving gear 14 is in the range from 0° to 2020 , the table part 10 becomes a state (an opened state in FIG. 2) of being waited in the highest position of an upward and downward movable range and also the driver unit 3 becomes a state (a wait state in FIG. 2) of being waited in the lowest position of the upward and downward movable range and further a clincher of the clinch device 5 becomes a protruded state (a protruded state in FIG. 2). This state is called a home position state. The home position state is maintained in the electric stapler 12 when the rotational angle is in the range from 0° to 20° and the range from 340° to 360° as shown in FIG. 2.

When a paper bundle is guided between the driver unit 3 and the table part 10 in the home position state and the motor 13 is started to actuate the main driving gear 14, the controller 18 detects a rotational state of the main driving gear 14 based on the rotational information detected by the rotation detector 15.

Figure 3A:
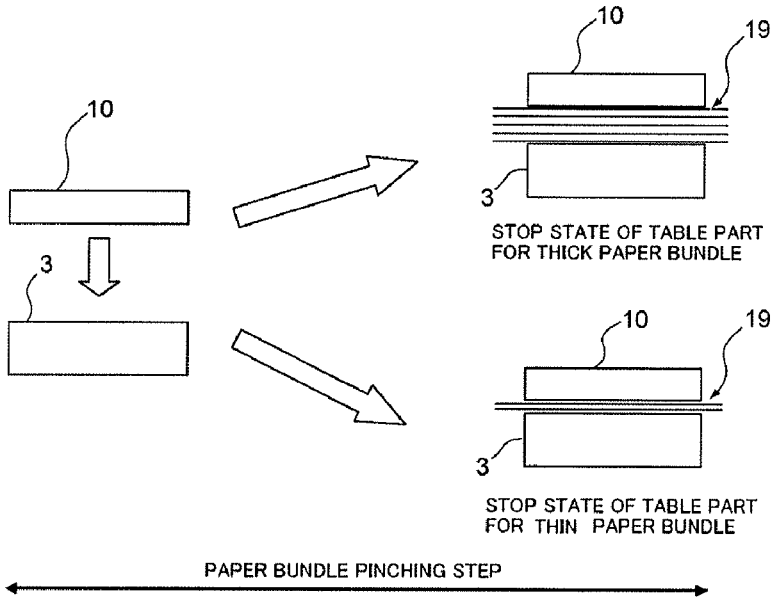
FIG. 3(*a*) is a diagram showing a condition to pinch a paper bundle by the table part and the driver unit.
Figure 3B:
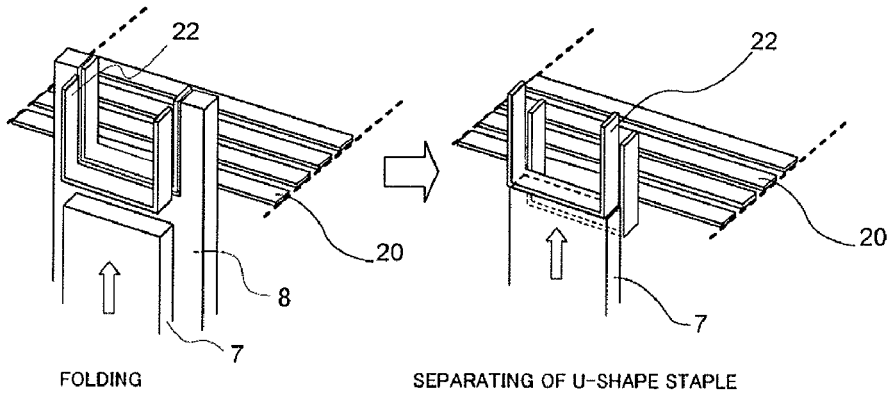
Figure 3C:
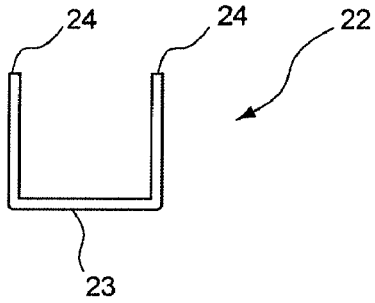

When the rotational angle exceeds 20°, the clincher of the clinch device 5 starts movement in a retracted position (a wait state in FIG. 2). Then, when the rotational angle exceeds 28°, as shown in FIG. 3(*a*), the table part 10 starts downward movement and becomes a state of pinching the paper bundle by the table part 10 and the driver unit 3 until the rotational angle reaches 90°. Thus, driving processing of the table part 10 performed at the time when the rotational angle of the main driving gear 14 is in the range from 28° to 90° (the range of arrow (1) in FIG. 2) corresponds to a paper bundle pinching step.

In the electric stapler 12 according to the exemplary embodiment, as shown in FIG. 2 and FIG. 3(*a*), when a paper bundle 19 is thick, the table part 10 becomes a state of abutting on the paper bundle 19 in a position in which the rotational angle is 60°, and thereafter an operation of the table part 10 becomes a state of being stopped by abutment on the paper bundle 19 (the range of arrow (2) in FIG. 2). Also, when the paper bundle 19 is thin (for example, when two sheets of paper are bound), the table part 10 becomes a state of abutting on the paper bundle 19 in a position in which the rotational angle is 90°, and thereafter the operation of the table part 10 becomes a state of being stopped by abutment on the paper bundle 19.

When the rotational angle exceeds about 70°, the forming plate 8 of the driver unit 3 is moved and a staple present in a forming position of a staple sheet 20 constructed of linear staples joined is folded into U-shape (forming processing) (see FIG. 3(*b*)). The folded staple is called as a U-shape staple. As shown in FIG. 3(*c*), the U-shape staple 22 is constructed of a crown part 23 positioned in a bottom surface and right and left legs 24 folded and erected in the right and left ends of the crown part 23.

After the straight staple in the staple sheet 20 is formed into the U-shape staple 22 by the forming plate, the driver 7 starts upward movement and pushes the crown part 23 of the U-shape staple 22 upward. By the upward movement of this driver 7, the U-shape staple 22 is separated (cut) from the staple sheet 20 as shown in FIG. 3(*b*). In the electric stapler 12 according to the exemplary embodiment, the U-shape staple 22 is cut at the rotational angle of about 105° as shown in (3) of FIG. 2. Thus, forming processing and cutting processing of the U-shape staple (processing of the range of arrow (4) in FIG. 2) performed in a state of rotating the main driving gear 14 from 70° to 105° correspond to a staple separation step.

Figure 4A:
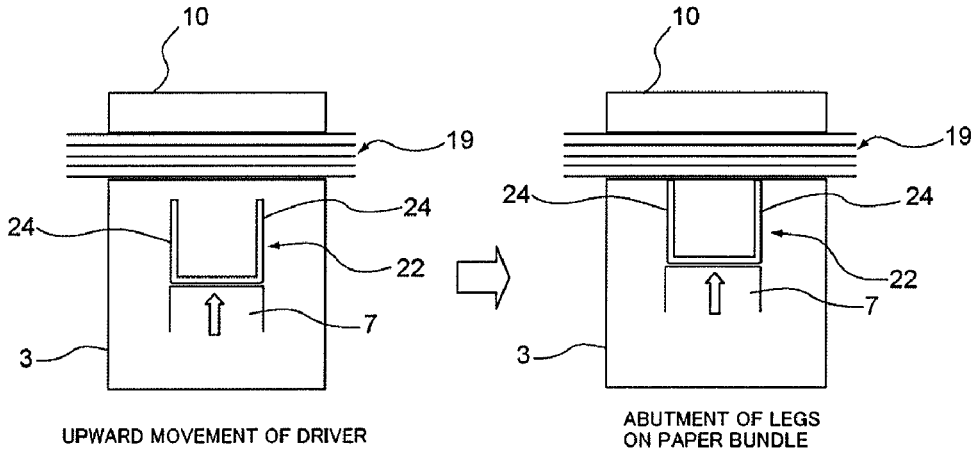
FIGS. 4(*a*) and 4(*b*) are diagrams stepwise showing conditions where the U-shape staple is penetrating into the paper bundle.
Figure 4B:
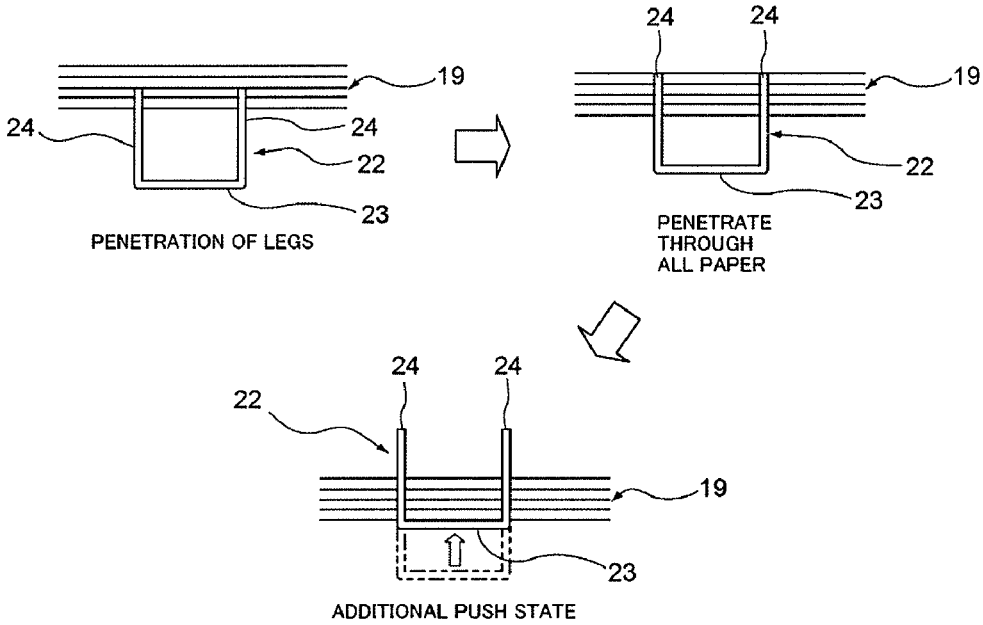

Next, by the upward movement of the driver 7, the separated U-shape staple 22 is moved toward the paper bundle 19 in a state that tops of the legs 24 direct to the paper bundle 19, and the tops of the legs 24 become a state of abutting on a lowest surface of the paper bundle 19 as shown in FIG. 4(*a*) ((5) in FIG. 2). Thereafter, with the further upward movement of the driver 7, the legs 24 of the U-shape staple 22 start penetration of the paper bundle 19 as shown in FIG. 4(*b*). In the embodiment, the legs 24 of the U-shape staple 22 start penetration of the paper bundle 19 from about 115° ((5) in FIG. 2).

By the further upward movement of the driver 7, the legs 24 of the U-shape staple 22 sequentially penetrate through the paper bundle 19 and the tops of the legs 24 become a state (a state of the range of arrow (6) in FIG. 2) of penetrating through all the paper at the rotational angle of about 165° as shown in FIG. 4(*b*). Thereafter, by the further upward movement of the driver 7, the crown part 23 reaches the lowest surface of the paper bundle 19 at about 187° as shown in (7) of FIG. 2. By the further upward movement of the driver 7, processing for pushing the U-shape staple 22 into the paper bundle 19 is continued until the rotational angle reaches 220° (processing of the range of arrow (8) in FIG. 2 and FIG. 4(*b*)) so that a press state (an additional push state) of the paper bundle 19 in a direction of the table part 10 by the U-shape staple 22 is maintained.

In addition, the heaviest load is applied to the paper bundle 19 from the U-shape staple 22 at about 220° (point A in FIG. 2) at which push processing of the U-shape staple 22 ends. Penetration processing (processing of the range of arrow (9) in FIG. 2) by the U-shape staple 22 performed in a state of rotating the main driving gear 14 from 115° to 220° corresponds to a penetration step.

Thereafter, when the rotational angle of the main driving gear 14 exceeds about 220°, driving of the clinch device 5 is started and the clincher starts processing for folding the legs 24 of the U-shape staple 22 penetrating through the highest surface of to the paper bundle 19 into the inside of both the legs 24. Until the rotational angle reaches 260° (the range of arrow (10) in FIG. 2), the processing for folding the legs is completed. The maximum point of a folding load of the processing for folding the legs by the clinch device 5 is timing (point B in FIG. 2) of this 260°. The processing for folding the legs 24 by the clinch device 5 performed in a state (arrow (10) in FIG. 2) of rotating the main driving gear 14 from 220° to 260° corresponds to a clinch step.

Thereafter, when the rotational angle is in the range from 275° to 330°, the table part 10 moves upward. When the rotational angle is in the range from 280° to 340°, downward movement processing (processing for returning to a wait position) of the driver 7 is performed. Thus, the driver unit 3 and the table part 10 are returned in a home position. Then, when the rotational angle is in the other range from 340° to 360°, the table part 10, the driver unit 3 and the clinch device 5 maintain a state of being waited in the home position, and a series of binding processing is ended. The upward movement processing of the table part 10 and the downward movement processing of the driver 7 (processing of the range of arrow (11) in FIG. 2) performed in a state of rotating the main driving gear 14 from 275° to 340° correspond to a paper bundle releasing step.

The controller 18 determines conditions of the binding processing described above by the rotational information detected by the rotation detector 15. The controller 18 sets the PWM control signal so that a PWM output state in the PWM control circuit 17 becomes a duty ratio of 100% at timing α (the range of arrow a in FIG. 2) from 135° to 222° including 220° at which the heaviest load is applied to the paper bundle 19 from the driver 7 through the U-shape staple 22 in the penetration step and timing β (the range of arrow β in FIG. 2) from 245° to 265° including 260° at which a value of the folding load becomes the highest value in the clinch step. Then, the controller 18 outputs the PWM control signal to the PWM control circuit 17.

On the other hand, the controller 18 sets the PWM control signal so that the PWM output state of the PWM control circuit 17 becomes a low value in a process of processing other than the timing α and the timing β described above. Then, the controller 18 outputs the PWM control signal to the PWM control circuit 17.

As described above, in the case of the rotational angle of 220° (the processing process of the timing α), the load applied to the paper bundle 19 by the driver 7 becomes the highest state, so that it is necessary to maintain a voltage supplied by the motor 13 in a rated state in order to implement sufficient pressurization processing. Also, in the case of the rotational angle of 260° (the processing process of the timing β), the folding load by the clincher becomes the highest state, so that it is necessary to maintain the voltage supplied to the motor 13 in the rated state in order to implement sufficient folding processing.

On the other hand, in the process of processing other than the timing α and the timing β described above, the high load is not imposed on the driver unit 3 or the clinch device 5, so that the binding processing is not disturbed even when the voltage supplied to the motor 13 is reduced. As a result of this, the controller 18 can reduce driving noise of the motor by reducing the voltage supplied to the motor 13 in the PWM control circuit 17 by PWM control.

Figure 5A:
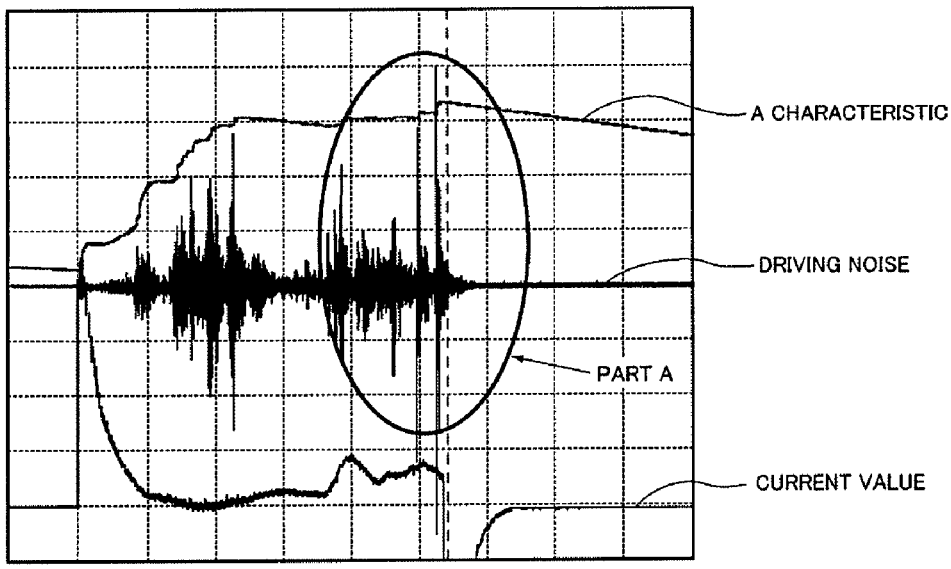
FIGS. 5(*a*) and 5(*b*) are graphs showing a change in a current value of the motor, an A characteristic of driving noise and the driving noise of the motor at the time of performing the binding processing of the paper bundle made of two sheets of paper, FIG. 5(*a*) shows the case where PWM control is not performed, and FIG. 5(*b*) shows the case where a duty ratio is set at 10% and PWM control is performed.
Figure 5B:
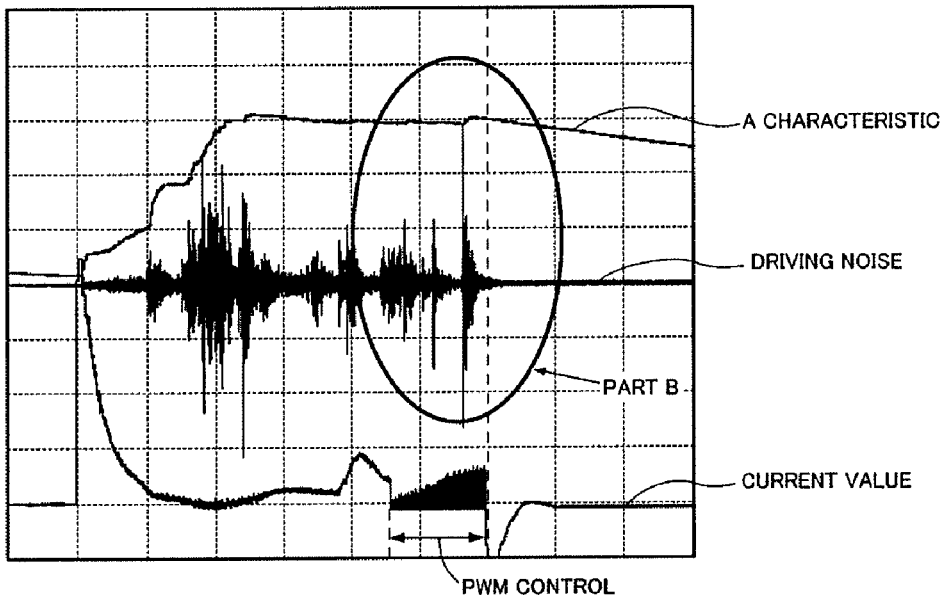

FIGS. 5(*a*) and 5(*b*) are graphs showing a change in a current value in the motor, an A characteristic of the driving noise and the driving noise of the motor at the time of performing the binding processing of the paper bundle made of two sheets of paper in the motor in which a voltage value is set at 24 V as one example, and FIG. 5(*a*) shows the case where in the binding processing, the voltage value is maintained constant at 24 V and PWM control is not performed, and FIG. 5(*b*) shows the case where in the paper bundle releasing step, a duty ratio is set at 10% and PWM control is performed.

The "A characteristic" is formally called as an "A weighted sound pressure level", and makes an auditory correction to a sound pressure level of the driving noise measured in association with sensitivity of human ears.

In comparison between the graph of FIG. 5(*a*) and the graph of FIG. 5(*b*), a value of the characteristic which is 63.6 dB in the case where the PWM control is not performed becomes 61.2 dB in the case where the PWM control is performed, and a sound reduction of 2.4 dB can be achieved. Also, in the driving noise of the motor 13 occurring in the paper bundle releasing step, a driving noise value (a place of part B of the graph of FIG. 5(*b*)) in the case where the PWM control is performed shows a value remarkably lower than the driving noise value (a place of part A of the graph of FIG. 5(*a*)) in the case where the PWM control is not performed.

Also, in the case of performing low-speed driving of the motor 13 by the PWM control, time of one cycle necessary for a series of binding processing becomes longer than that of the case where the PWM control is not performed by 30 msec, but it can be determined that a time delay of this extent is at a level at which the delay is unnoticeable to the binding processing time.

Figure 6A:
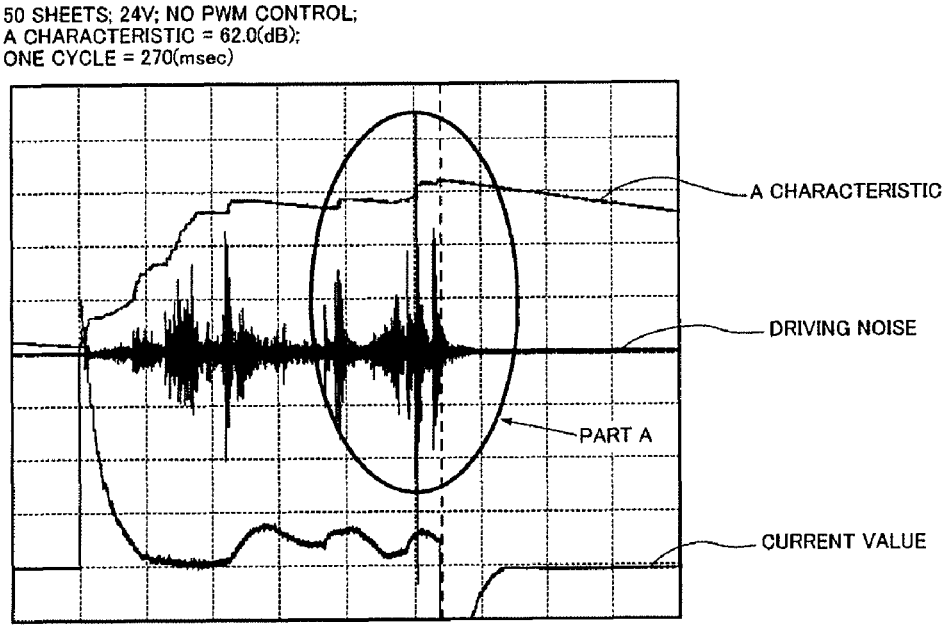
FIGS. 6(*a*) and 6(*b*) are graphs showing a change in a current value of the motor, an A characteristic of driving noise and the driving noise of the motor at the time of performing the binding processing of a paper bundle made of 50 sheets of paper, FIG. 6(*a*) shows the case where PWM control is not performed, and FIG. 6(*b*) shows the case where a duty ratio is set at 10% and PWM control is performed.
Figure 6B:
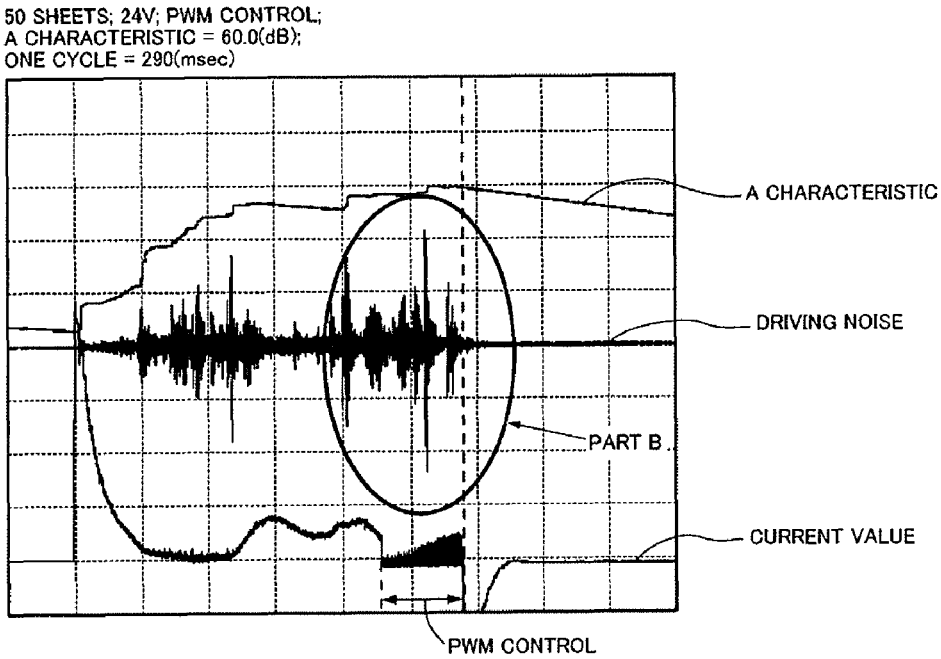
Figure 7:
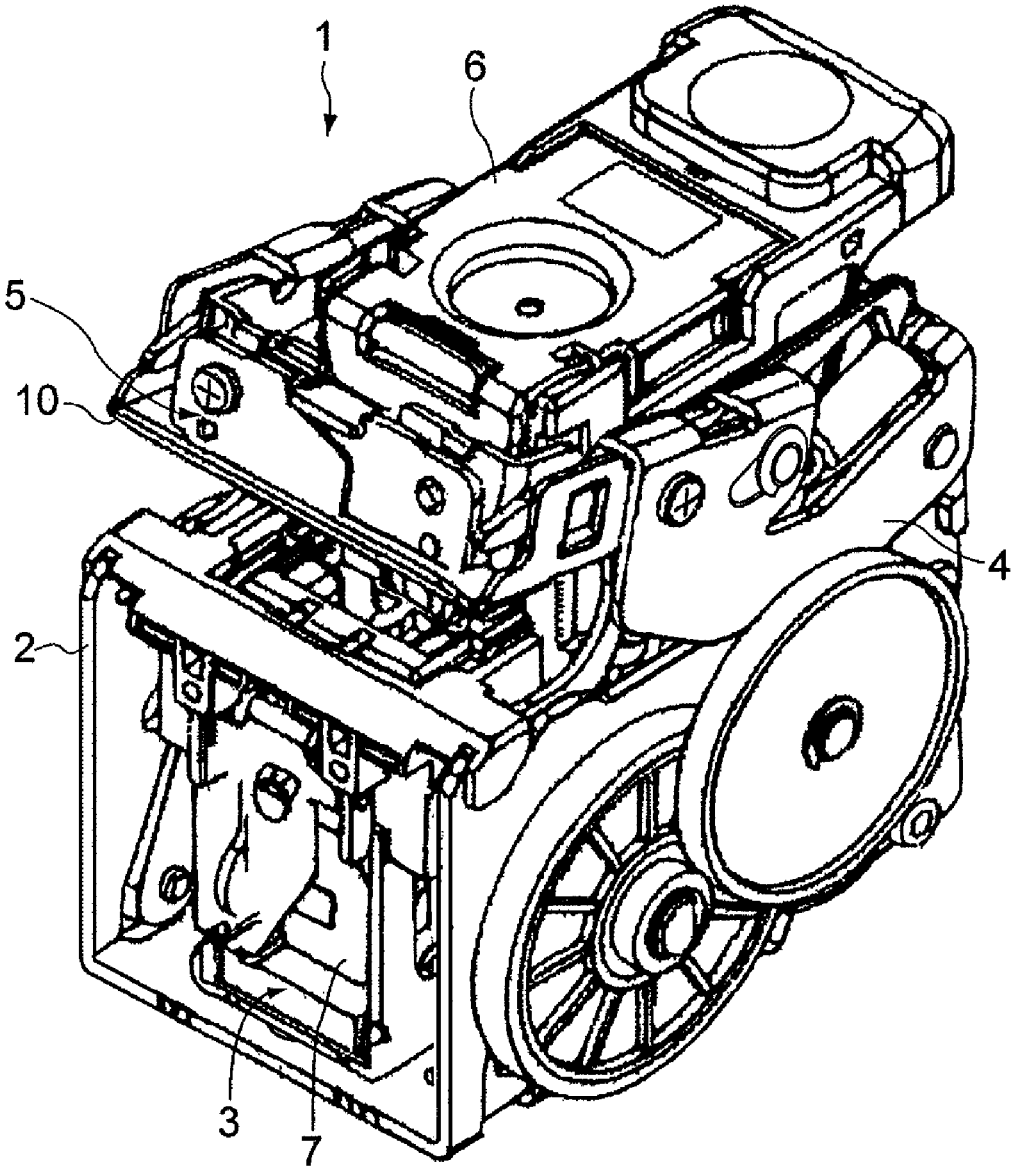
FIG. 7 is a perspective view describing a structure of a general electric stapler.

FIGS. 6(*a*) and 6(*b*) are graphs showing a change in a current value in the motor, an A characteristic of the driving noise and the driving noise of the motor 13 at the time of performing the binding processing of the paper bundle made of 50 sheets of paper in the motor in which a voltage value is set at 24 V, and FIG. 6(*a*) shows the case where in the binding processing, the voltage value is maintained constant at 24 V and PWM control is not performed, and FIG. 6(*b*) shows the case where in the paper bundle releasing step, a duty ratio is set at 10% and PWM control is performed.

In comparison between the graph of FIG. 6(*a*) and the graph of FIG. 6(*b*), a value of the characteristic which is 62.0 dB in the case where the PWM control is not performed becomes 60.0 dB in the case where the PWM control is performed, and a sound reduction of 2.0 dB can be achieved. Also, in the driving noise of the motor 13 occurring in the paper bundle releasing step, a driving noise value (a place of part B of the graph of FIG. 6(*b*)) in the case where the PWM control is performed shows a value remarkably lower than the driving noise value (a place of part A of the graph of FIG. 6(*a*)) in the case where the PWM control is not performed.

Also, in the case of performing low-speed driving of the motor 13 by the PWM control, time of one cycle in the binding processing becomes longer than that of the case where the PWM control is not performed by 20 msec, but it can be determined that a time delay of this extent is at a level at which the delay is unnoticeable to the binding processing time.

In the electric stapler 12 according to the exemplary embodiment thus, the voltage supplied to the motor is maintained in the rated state at processing timing of the binding processing in which the high load is required in the driver unit 3 or the clinch device 5, so that a reduction in binding performance in the electric stapler can be prevented and on the other hand, the voltage supplied to the motor is reduced by the PWM control at processing timing at which the high load is not required in the driver unit or the clinch device and thereby, a reduction in the driving noise of the motor can be achieved without interfering with the binding processing.

Further, the electric stapler 12 according to the exemplary embodiment performs driving speed control of the motor 13 by the PWM control circuit 17 by the PWM control signal outputted from the controller 18, so that the driving speed control of the motor can be performed at various timings and driving speeds without changing components (for example, an upward and downward movement mechanism of the table part 10, a structure of the driver unit or a structure of the clinch device) for implementing the paper bundle pinching step, the staple separation step, the penetration step, the clinch step and the paper bundle releasing step.

Since the speed control of the motor 13 is performed according to control of the controller 18 thus, there is no need to use a special component such as a high-performance motor, a gear box or a belt conversion mechanism and also, an increase in management cost or component cost or an increase in a kind of product associated with an increase in the number of components can be reduced.

Although the electric stapler and the operation method in the electric stapler according to the invention have been described above in detail based on the exemplary embodiment of the invention using the drawings, the electric stapler and the operation method of the invention are not limited only to the electric stapler 12 and the operation method of the exemplary embodiment. It will be obvious to those skilled in the art that various changes and modification may be made therein without departing from the present invention. It is aimed, therefore, to cover in the appended claims all such changes and modifications falling within the true spirit and scope of the present invention.

For example, in the electric stapler 12 according to the exemplary embodiment, the case of performing the PWM control in only the paper bundle releasing step as shown in FIGS. 5 and 6 has been shown, but timing at which the PWM control is performed is not limited to only the paper bundle releasing step, and may be the paper bundle pinching step, the staple separation step, etc.

Also, in the electric stapler 12 of the exemplary embodiment, the case of using the PWM control as the method for implementing the reduction in the voltage supplied to the motor 13 has been described, but the method for reducing the voltage supplied to the motor 13 is not limited to only the PWM control, and other methods, for example, PAM (Pulse Amplitude Modulation) control may be used.

Further, in the electric stapler 12 according to the exemplary embodiment described above, the configuration example using the photointerrupter as one example of the configuration of detecting the rotational angle state of the main driving gear 14 has been described, but the configuration of detecting the rotational angle state is not limited to only the photointerrupter. Any method may be used as long as a configuration capable of determining the processing timing and the contents of processing in the binding processing by control means is used.

For example, a configuration of determining the processing timing and the contents of processing of the binding processing by the control means based on time elapsed since rotation of the main driving gear 14 was started may be used and also, a configuration of determining the contents of processing in the binding processing by the control means by using a timing sensor for outputting the contents of processing according to a predetermined rotational manipulation of the main driving gear may be used.

Also, in the electric stapler 12 according to the embodiment described above, the mechanism for moving the table part 10 and pinching the paper bundle 19 by the table part 10 and the driver unit 3 has been shown, but the electric stapler according to the invention is not limited to such a structure, and a mechanism in which the driver unit side moves to the table part and the paper bundle is pinched may be used or a mechanism in which both of the driver unit and the table part move and the paper bundle is pinched may be used. The point is, the mechanism in which the driver unit and the table part move relatively and the paper bundle 19 is pinched could be used.

In the exemplary embodiment, the table part 10 is positioned in an upper side and the driver unit 3 is positioned in a lower side. However, in the invention, a relational positioning of the table part 10 and the driver unit 3 is not limited to this. For example, the table part 10 may be positioned in the lower side and the driver unit 3 may be positioned in the upper side. The table part 10 may be positioned in a left side and the driver unit 3 may be positioned in a right side. The table part 10 may be positioned in the right side and the driver unit 3 may be positioned in the left side.

[DESCRIPTION OF REFERENCE NUMERALS AND SIGNS]

1,12 ELECTRIC STAPLER
2 FRAME
3 DRIVER UNIT
4 CLINCHER ARM
5 CLINCH DEVICE
6 STAPLE CARTRIDGE
7 DRIVER
10 TABLE PART
13 MOTOR
14 MAIN DRIVING GEAR
15 ROTATION DETECTOR (ROTATIONAL STATE DETECTION DEVICE)
16 POWER SOURCE
17 PWM CONTROL CIRCUIT (A MOTOR CONTROL UNIT)

18 CONTROLLER (A MOTOR CONTROL UNIT)
19 PAPER BUNDLE
20 STAPLE SHEET
22 U-SHAPE STAPLE (STAPLE)
23 CROWN PART (OF U-SHAPE STAPLE)
24 LEG (OF U-SHAPE STAPLE)

What is claimed is:

1. An operation method of an electric stapler, the method comprising:

a paper bundle pinching step of relatively moving a table part and a driver unit and also pinching a paper bundle by the table part and the driver unit;

a staple separation step of folding a staple located at a forming position of staples in a staple sheet into U-shape by a forming plate provided in the driver unit and also separating the folded U-shape staple from the staple sheet by moving a driver provided in the driver unit;

a penetration step of penetrating legs of the staple into the paper bundle by further moving the driver;

a clinch step of inward folding the legs penetrating through the paper bundle by a clinch device; and a paper bundle releasing step of releasing the paper bundle by relatively moving the table part and the driver unit in a direction of moving away from each other, wherein a relative movement of the table part and the driver unit, the forming plate, the driver, and the clinch device are powered by a single motor, wherein a driving speed of the motor is controlled by a controller, and wherein the driving speed of the motor in the steps excluding the penetration step and the clinch step is slower than the driving speed of the motor in the penetration step and the clinch step.

2. The method according to claim 1, further comprising:

a step of detecting a rotational state of a main driving gear driven by the motor; and a step of determining a processing time of the steps including the penetration step and the clinch step based on the detected rotational state of the main driving gear and also controlling the driving speed of the motor.

3. An operation method of an electric stapler, wherein the electric stapler including a motor, a table part, a driver unit, a forming plate in the driver unit, a driver in the driver unit, and a clinch device, the method comprising:

relatively moving the table part and the driver unit in a direction to be close to each other and pinching a paper bundle between the table part and the driver unit, by rotating said motor in a first speed;

actuating the forming plate and folding a staple located at a forming position of staples in a staple sheet into U-shape, by rotating said motor in a second speed;

moving the driver and separating the folded U-shape staple from the staple sheet, by rotating said motor in a third speed;

further moving the driver and penetrating legs of the U-shape staple into the paper bundle, by rotating said motor in a fourth speed;

actuating the clinch device and clinching the legs penetrating through the paper bundle, by rotating said motor in a fifth speed; and relatively moving the table part and the driver unit in a direction of moving away from each other and releasing the paper bundle, by rotating said motor in a sixth speed, wherein the first, second, third, and sixth speeds are lower than the fourth and fifth speeds.

4. The operation method of an electric stapler of claim 1, wherein the driving speed of the motor is controlled by pulse width modulation.

5. The operation method of an electric stapler of claim 1, wherein the driving speed of the motor is controlled by pulse amplitude modulation.

* * * * *